United States Patent [19]

Jackson et al.

[11] 4,305,636

[45] Dec. 15, 1981

[54] ELECTRICAL CONNECTORS FOR UNDERWATER STREAMERS

[75] Inventors: Doreen F. Jackson, Laguna Beach; Norbert L. Moulin, Placentia; Leslie L. Kerek, Irvine, all of Calif.

[73] Assignee: Hughes Aircraft Company, Culver City, Calif.

[21] Appl. No.: 127,339

[22] Filed: Mar. 5, 1980

[51] Int. Cl.[3] ..... H01R 13/52

[52] U.S. Cl. ..... 339/117 R; 339/94 M

[58] Field of Search ..... 339/94 R, 94 M, 117 R

[56] References Cited

U.S. PATENT DOCUMENTS 3,980,369 9/1976 Panek ..... 339/117 R 4,133,593 1/1979 Moulen ..... 339/94 R

*Primary Examiner*—Joseph H. McGlynn

*Attorney, Agent, or Firm*—Lewis B. Sternfels; W. H. MacAllister

[57] ABSTRACT

Seals (66) are coupled in fluid and pressure tight engagement between respective contacts (18) and their bores (26) and are positioned between the front end (42) and perforations (48, 50) of a wire-receiving end (40) to prevent leakage of fluid (16) within a jacket (12) into the bores adjacent to the front ends of the contacts.

9 Claims, 2 Drawing Figures

ELECTRICAL CONNECTORS FOR UNDERWATER STREAMERS

BACKGROUND OF THE INVENTION

1. Field of the Invention

The present invention relates to electrical connectors and, in particular, to contacts environmentally sealed within such connectors for use with underwater streamers.

2. Description of the Prior Art

Environmental sealing of electrical contacts within their insulated connector bodies sometimes raise special problems when applied to specific environments. In particular, streamers used in underwater towed cables and the like give rise to special pressure and sealing problems. Such streamers or underwater cables comprise a wire bundle enclosed in a fluid-filled jacket and terminated by electrical connectors and contacts therein coupled to individual wires. Sea pressure exerts large forces on the jacket and the enclosed fluid and, unless the contacts were properly sealed in their bores of the connector body, fluid would be forced to the front of the connector.

Potting, tight packing seals and hermetic contacts have been used to effect the proper fluid and pressure-type sealing required in such systems, but without the absence of problems. The major disadvantage to potting is that once the contacts are potted in the connector, it is not possible to repair or replace them and the malfunctioning connector must then be discarded. The same problem results from the use of hermetic contacts, which are also not removable from the connector body. Packing seals, while overcoming the repair disadvantage of potting, require great pressure to tighten the seals securely in place to withstand leakage. Through use or improperly applied pressure, the quality of their sealing will deteriorate and the fluid within the streamer will then leak past the contacts.

A further system which overcomes the disadvantages of potting and pressure seals is disclosed in U.S. Pat. Nos. 3,792,416 and 4,133,593, respectively entitled, "System, Method and Seal for Pressure-Sensitive Wire and Interface Sealing of Electrical Connector Assemblies and Associated Contacts" and "Pressure Sensitive Seal for Wire and Interface Sealing of Individual Contacts in and between Electrical Connectors," both by Norbert L. Moulin, one of the co-inventors herein. Both describe seals for, and sealing of, electrical contacts from the environment external to the interior of a connector regardless of changing pressure conditions. One of the seals disclosed therein, a pressure-sensitive wire seal at the rear of each connector, includes a tubular portion jacketed in sealing contact on the conductor insulation, a cup-shaped flange opening toward the rear of the connector, a wiper land inwardly disposed of the cup-shaped flange, and an interlocking engagement between the seal and the wire-receiving end of the contact. Because the cup-shaped flange faces rearwardly, sealing is proportionately enhanced when the pressure external to the bore, in which the contact is sealed, increases as a result of increased sealing pressure exerted against the cup-shaped flange.

In both patents, the pressure-sensitive wire seal is positioned on the wire-receiving end of the contact. Such wire-receiving ends conventionally include holes or perforations which provide an access for crimping or soldering and inspection of the wire which is soldered or crimped within the contact end. Placement of a wire seal behind the inspection hole in a fluid-filled streamer or underwater cable gives rise to a special, but serious problem. Specifically, due to the pressures exerted on the fluid in the streamer jacket, the fluid is forced along the wires or cables and enters the wire-receiving end of the contact. Thence, it moves through the inspection hole to the front, contact mating end of the contact. Thus, the fluid by-passes the pressure-sensitive wire seal.

SUMMARY OF THE INVENTION

The present invention overcomes this specific problem by placing the inspection hole behind, instead of in front of, the pressure-sensitive seal.

It is, therefore, an object of the present invention to provide for environmental sealing of electrical contacts in underwater streamers.

An another object is to prevent wicking along a wire through the interior of a contact.

Other aims and objects as well as a more complete understanding of the present invention will appear from the following explanation of an exemplary embodiment and the accompanying drawings thereof.

DETAILED DESCRIPTION OF THE INVENTION

Figure 1:
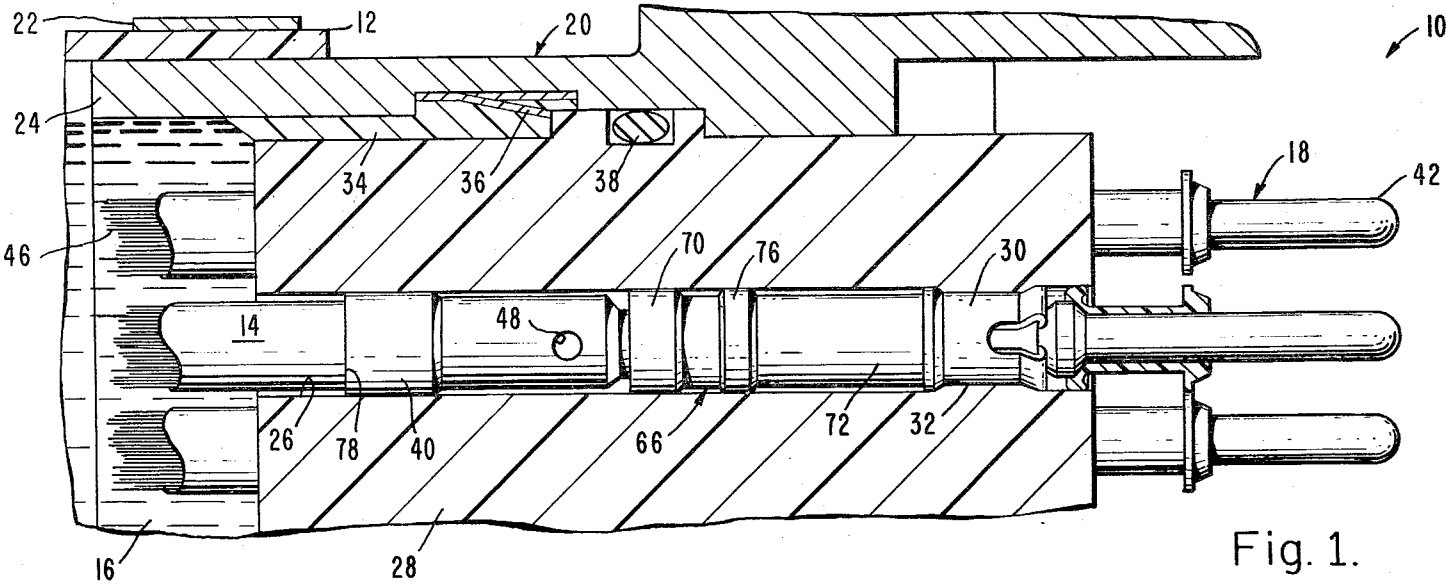
FIG. 1 is a view of a sectioned portion of an electrical connector terminating an underwater streamer.
Figure 2:
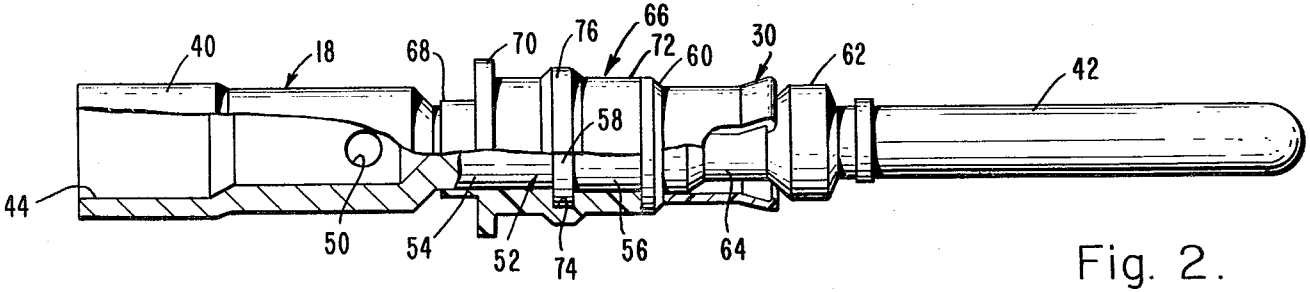
FIG. 2 is a view of the contact with the seal thereon prior to its insertion within its insulator body.

As shown in FIG. 1, a typical underwater streamer assembly 10 includes a jacket 12 enclosing a plurality of cables 14 which comprise a part of a wire bundle. As is typical in such streamer assemblies, a non-conductive fluid 16 is enclosed within jacket 12 about the wire bundle. Each cable 14 is terminated in a contact 18 while jacket 12 is terminated in a receptacle shell 20, by any suitable means which will provide a fluid and pressure-tight connection, such as by any annular clamping band 22 to rear portion 24 of the shell.

Contacts 18 are retained within bores 26 of an insulator body 28 by any suitable means, such as by retaining clips 30 on contacts 18 cooperating with shoulders 32 of insulator body 28 extending within bores 26. The retaining clips are of a spring material so that, when the contacts are inserted within their respective bores, the clips engage their respective shoulders for a latching engagement therebetween. Insulator body 28, in turn, is secured within receptacle shell 20 by any suitable means such as by use of a potting compound 34 and a retaining clip 36. An O-ring seal 38 between the insulator body and the receptacle shell provides further sealing. Contacts 18, which are here depicted as pin contacts, are adapted to mate with socket contacts housed within a plug barrel, and the plug barrel and the receptacle shell are mated in a conventional manner.

Pin 18 includes a wire-receiving rear end 40 and a pin front end 42. Wire-receiving end 40 is provided with a bore 44 for reception of wire 46. As is conventional, the wire is soldered or crimped within rear end 40. A pair of holes 48 and 50 perforate end 40 and act as solder and inspection holes.

Extending forwardly towards front end 42 of the contact, is a shank portion 52 comprising two diameter shanks 54 and 56 with a latching collar 58 intermediate the two shanks. Shank 56 is terminated by a collar 60 which, with an annular portion 62 defines a recess 64 for reception of retaining clip 30.

Disposed within and latched and secured to contact 18 on shank portion 52 is a pressure-sensitive seal 66, placed on each contact. Each seal is generally tubular in configuration and includes a tubular, contact-gripping end portion 68, a radially extending flange 70, and a contract-gripping front portion 72. A recess 74 on the interior of seal 66 cooperates with annular latching collar 58 so that the seals are resiliently held onto their respective contacts. Each seal is completed by a wiping land 76 which is positioned at a point where latching collar 58 meets with recess 74.

Placement of the pressure-sensitive seal is effected with respect to pin contact 18 by manipulating portion 72 over rear end 40 and annular collar 58 in such a manner that front portion 72 of the seal fits over shank 56 of the contact, recess 74 is engaged about collar 58, and tubular end portion 68 grips shank 54.

Thereafter, cable 14 with its insulation stripped to point 78 is secured to contact 18, with bare wire 46 extending within bore 44 of wire-receiving end 40. Rear end 40 is then crimped about the bared wire portion by conventional crimping operations or, alternatively, solder may be flowed through holes 48 and 50.

After all pin and socket contacts with their insulated conductors and pressure-sensitive seals are assembled, the contact assemblies are then inserted within bores 26 of insulator body 28. As each contact is placed within its bore, wiping land 76 first makes contact with bore 26 to clean the contact cavity prior to entry of annular flange 70. Upon still further insertion of the contact into the bore, annular flange 70 meets the bore at its rear face and deforms the flange into its sealing cup-shaped configuration as shown in FIG. 1. Upon complete insertion of the contact within the bore, flange 70 completely deforms while, at the same time, retaining clip 30 snaps over annular shoulder 32 to retain the contact within connector body 28.

Inasmuch as pressure-sensitive seal 66 is placed between wire-receiving end 40 and front end 42 of contact 18 and, in particular, forwardly of holes 48 and 50, complete sealing of the contact at front end 42 of the contact is assured. Thus, any of fluid 16 attempting to pass into bore 26 adjacent front end 42 is prevented from doing so particularly by cooperation between bent over flange 70 and contact with bore 26. Any fluid 16, which might enter bore 44 of wirereceiving end 40 by passing along the insulation or bared wire to holes 48 and 50, also cannot reach front end of contact 18 inasmuch as seal 66 also provides a barrier thereto.

Although the invention has been described with reference to a particular embodiment thereof, it should be realized that various changes and modifications may be made therein without departing from the spirit and scope of the invention.

What is claimed is:

1. An electrical connector for terminating an underwater streamer including a wire bundle enclosed in a fluid-filled jacket comprising:

an insulating body having a plurality of contact-receiving bores therethrough and coupled to said jacket in fluid and pressure tight engagement therewith;

a plurality of contacts received and retained respectively in the bores, each of said contacts comprising a rear end having a perforate bore receiving a wire of said wire bundle and a front end for electrical coupling with a mating contact; and seals coupled in fluid and pressure tight engagement between respective ones of said contacts and their bores and positioned between said front end and the perforation in said rear end for preventing leakage of any fluid in said jacket into said insulating body bores adjacent said contact front ends.

2. An electrical connector according to claim 1 in which each of said contacts includes a shank portion adjacent said wire-receiving end and extending towards said front end, said shank portion having means for retaining one of said seals thereon.

3. An electrical connector according to claim 2 in which each said seal includes a substantially peripheral, radially extending, flexible flange bent upon insertion of each of said contacts into said insulating body bores and capable of resisting flow of fluid into the bore when the pressure within it is less than the pressure without.

4. A system as in claim 3 wherein each of said seals includes means coupling said seal to each of said shanks.

5. A system as in claim 3 wherein each of said seals further includes an annular land adjacent said radially extending flange.

6. A system as in claim 3 wherein each said shank includes a peripheral latching collar cooperable with each said seal for securement thereof with each said contact.

7. A system as in claim 6 wherein said seal includes a recess cooperable with said latching collar for the securement.

8. An electrical connector according to claims 2 or 7 further including a contact-to-bore retention mechanism including a clip on said contact positioned between said shank portion and said front end and terminated by an annular clip retaining collar adjacent said shank portion, said shank portion having a diameter of smaller dimension than that of said wire-receiving end and said clip retaining collar for securement of said seal to said contact.

9. An electrical connector according to claim 8 wherein said seal includes tubular portions on both sides of said flange in sealing and gripping engagement with said shank portion.

* * * * *